US005301789A

United States Patent [19]

Jönsson

[11] Patent Number: 5,301,789

[45] Date of Patent: Apr. 12, 1994

[54] APPARATUS FOR THE CONTROLLED INFEED STORAGE AND DISCHARGE OF ELONGATE OBJECTS

[76] Inventor: Holger Jönsson, Tylla 4, S-781 94 Borlänge, Sweden

[21] Appl. No.: 853,761

[22] PCT Filed: Dec. 4, 1990

[86] PCT No.: PCT/SE90/00800

§ 371 Date: Jun. 1, 1992

§ 102(e) Date: Jun. 1, 1992

[87] PCT Pub. No.: WO91/08154

PCT Pub. Date: Jun. 13, 1991

[30] Foreign Application Priority Data

Dec. 4, 1989 [SE] Sweden ..... 8904089-3

[51] Int. Cl.[5] ..... B65G 1/00

[52] U.S. Cl. ..... 198/347.3; 198/750; 198/778; 414/416; 414/745.1; 414/745.2; 414/746.8

[58] Field of Search ..... 198/347.3, 750, 778; 414/416, 417, 745.1-745.3, 746.8

[56] References Cited

U.S. PATENT DOCUMENTS

| | | | |
|---|---|---|---|
| 1,189,965 | 7/1916 | Kelley, Jr. . | |
| 3,367,535 | 11/1966 | Tanguay . | |
| 3,478,923 | 11/1969 | Fisher . | |
| 4,475,643 | 10/1984 | Klingenberg | 198/347.3 |
| 4,509,634 | 4/1985 | Payne | 198/347.3 |
| 4,547,963 | 10/1985 | Ohmstede | 414/745.3 |
| 5,005,689 | 4/1991 | Maier et al. | 198/347.3 |
| 5,123,806 | 6/1992 | Pankowiecki | 414/745.3 |
| 5,191,693 | 3/1993 | Umetsu | 198/347.3 |
| 5,201,910 | 4/1993 | Sheeter | 198/347.3 |

FOREIGN PATENT DOCUMENTS

| | | | |
|---|---|---|---|
| 190531 | 8/1986 | European Pat. Off. | 198/347.3 |
| 1039444 | 9/1958 | Fed. Rep. of Germany | 198/347.3 |
| 3438123 | 4/1986 | Fed. Rep. of Germany | 198/347.3 |

*Primary Examiner*—Joseph E. Valenza

*Attorney, Agent, or Firm*—Frishauf, Holtz, Goodman & Woodward

[57] ABSTRACT

The disclosure relates to an apparatus for the controlled infeed, storage and discharge of elongate objects (20, 21, 22, etc.). The apparatus essentially includes a rotary drum (1) and at least one strap, belt or the like (2, 3, 4). The invention, the strap, belt or the like (2, 3, 4) is connected to the rotary drum (1) which is disposed to rotate in two different directions for winding up and unwinding of the belt (2, 3, 4) or the like. The elongate objects (20, 21, 22, etc.) are aligned with the drum (1), are disposed on the belt (2, 3, 4) or the like, and are arranged to be held by the belt (2, 3, 4) or the like against the rotary drum (1). The belt (2, 3, 4) or the like and/or the elongate objects (20, 21, 22, etc.) are moreover disposed to be prevented from movement in their storage position by a holding device (6).

12 Claims, 1 Drawing Sheet

APPARATUS FOR THE CONTROLLED INFEED STORAGE AND DISCHARGE OF ELONGATE OBJECTS

TECHNICAL FIELD

The present invention relates to an apparatus for the controlled infeed, storage and discharge of elongate objects. This apparatus essentially comprises a rotary drum and at least one belt, strap or the like.

BACKGROUND ART

Within such areas as the manufacturing industry, problems are experienced in the efficient handling of elongate objects on their transport between machining stations, on infeed into and discharge from the machining machines and also in the very storage of elongate objects before and after being machined. In particular in those cases in which machining takes place a large number of times of one and the same elongate object—and hence handling of such elongate objects takes place many times—the importance will readily be perceived of an efficient handling of such objects with slight or no manual labour input. For the elongate objects themselves, it is vital that the machining which has been carried out is not damaged or affected to any appreciable extent by handling and storage in connection with the machining proper.

The method most commonly employed today—despite all of the modernization which has been introduced with the aid of industrial robots, computers etc.—is to pick the object manually from and to a box, a container, a pallet etc., in applicable cases by stacking. The time consumption for this manual picking is considerable since the operation is repeated many times, with the result that the machining work is rendered considerably more expensive because of the handling process itself. In addition, the frequency of damage caused in such manual picking is considerable.

Moreover, objects which are stored loose in boxes, crates etc. are relatively theft-prone, stock-taking of objects in stores etc. is impeded and more expensive and, finally, production-line machining defies on-the-spot monitoring, for example for estimating delivery times etc.

The storage of flexible sheet material in rolls or coils is previously known in this art, for example for strip steel, such storage generally providing adequate protection for sheet material and, moreover, creating favourable conditions for rational handling at a workstation, where, for instance, infeed to a punch for punching details from the strip steel may relatively easily be automated. Coiling of such a roll is generally effected on a drum and, after completed coiling, the roll is strapped to prevent unwinding.

OBJECT OF THE INVENTION

The object of the present invention is to devise an apparatus which permits simple and efficient handling and storage of elongate objects. The term elongate objects is here taken to signify all types of objects of all kinds of materials in which the length of the object exceeds its cross-sectional area. Typical examples of elongate objects are pipes, sections, etc. of steel, aluminium, plastic, wood, etc.

In the apparatus mentioned by way of introduction, the present invention is characterized in that the above-mentioned at least one belt, strap or the like is connected to the rotary drum which is arranged to rotate in two different directions for coiling and uncoiling the above-mentioned strap or belt; that the above-mentioned elongate objects are aligned with the drum and are localized on the belt or strap and are disposed to be retained by the belt or strap against the rotary drum; and that the strap or belt and/or the elongate objects are arranged to be prevented by a holding device from movement while in the storage position. One advantageous embodiment of the present invention is characterized in that the above-mentioned belt or strap is disposed to be driven in one direction of rotation by the rotary drum and/or by an external prime mover so as to be wound up on the rotary drum; and that the strap or belt is disposed, in the other direction of rotation, to be unwound from the rotary drum by a second external prime mover, for instance connected to the outer end of the strap or belt.

According to one particularly preferred embodiment of the present invention, the strap or belt consists of at least two straps distributed along the length of the drum, and preferably one holding device allocated for each belt or the like, each holding device including a pressure distributor and a friction reducer which are disposed for alternating cooperation with their associated belt or the like and./or with the stored elongate objects.

BRIEF DESCRIPTION OF THE ACCOMPANYING DRAWINGS

The nature of the present invention and its aspects will be more readily understood from the following brief description of the accompanying drawings, and discussion relating thereto.

In the accompanying drawings.

It should be observed that details which essentially correspond to one another have been given the same reference numerals in the description below and on the drawings, for purposes of simplification.

DESCRIPTION OF PREFERRED EMBODIMENT

Figure 1:
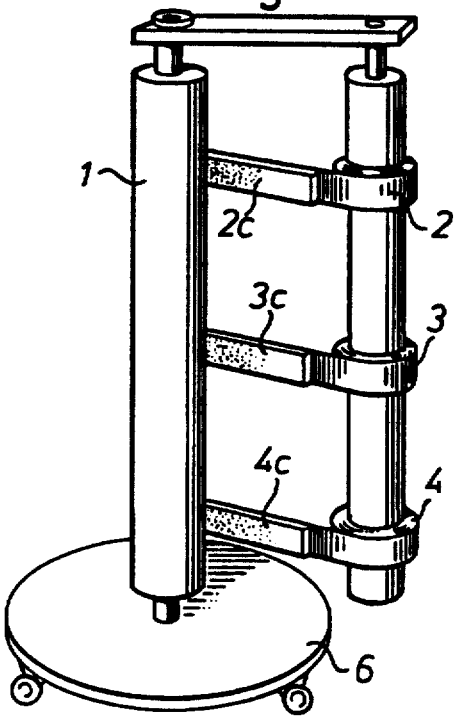
FIG. 1 illustrates the fundamental design of the apparatus according to the invention.

Referring to the drawings, the inventive concept as illustrated in FIG. 1 essentially comprises a drum 1 which is rotatably driven in two mutually opposing directions in a manner not shown in detail on the drawing. This drum 1 may be disposed vertically—see FIG. 1 —or horizontally—see FIG. 4—or in any position therebetween and is made of a pipe, section or the like of sufficient mechanical strength and rigidity to withstand the loads which may be involved.

The one end 2*a* of at least one belt or the like 2 is connected to the drum 1, this strap, belt or the like being of a suitable, flexible material, for instance woven fabric, with little or no stretch at the loadings contemplated here. In the embodiment illustrated in FIG. 1, three belts 2, 3, 4 are employed, these being distributed along the length of the drum 1 and all being mechanically connected at their one ends 2a, 3a, 4a to the drum 1 in a suitable manner along a straight line. From their connection point with the drum I and for a length corresponding to approximately one turn about the drum 1, each belt 2, 3 and 4, respectively, is provided, on its side facing the drum 1, with a yieldable or elastic layer 2c, 3c and 4c, respectively, as particularly indicated in FIG. 2. This elastic layer 2c, etc. is of an extent or thickness, seen in the radial direction of the drum I and in the unloaded state, which corresponds substantially to the thickness or cross-section of the elongate objects 20, 21, 22, 23, etc. which are to be handled by the apparatus, the layer terminating—as indicated in the left-hand section of FIG. 2 abruptly, for the purpose of constituting an arrest device for the first, 20, of the elongate objects.

Figure 2:
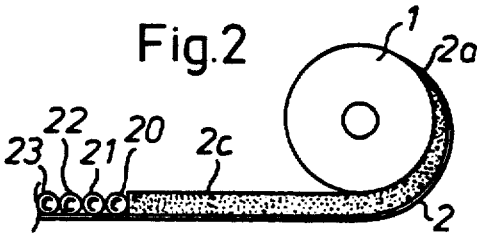
FIG. 2 shows, in cross-section, parts of the apparatus according to FIG. 1 in greater detail.

On driven anti-clockwise rotation of the drum I according to FIG. 2 (this operation not being shown in detail on the drawing), the belt 2 is wound up on the drum 1 with the elastic layer 2c abutting against the outer surface of the drum 1. The elongate objects 20, il, etc. are continuously supplied to the belt 2 from the left as intimated in FIG. 2, so that the first elongate object 20 abuts against the arrest device formed by the end of the elastic layer 2c and the following elongate object 21 abuts against the first elongate object 20, the third elongate object 22 against the second elongate object 21, and so on. If desired or necessary, suitable spacers may, of course, be inserted in order also to keep the elongate objects 20, 21, 22, 23, etc. in mutually spaced-apart relationship. However, such spacers are not normally required. By such winding-up of the belt 2, with a regular supply of elongate objects 20, etc., the elongate objects 20, etc., will be wound up about the drum 1, thereby forming the battery of wound-up elongate objects as illustrated in, for instance, FIG. 3. The elastic layer, 2c, 3c, 4c, etc. of each belt 2, 3, 4, etc. consequently acts as a pressure distributor and load distributor for the first turn about the drum I with elongate objects 20, etc. In the embodiment according to FIGS. 1 and 3, the elongate objects 20, 21, 22, 23, etc. are stored vertically. In the embodiment according to FIG. 3, the belt 2 or belts 2, 3, 4 (whose number may, of course, be varied), are connected (for example mechanically) at their other ends 2b, 3b, 4b, to a second drum 5 or prime mover which may, in a manner not shown in detail on the drawing, be rotated so as to wind up and unwind the belt 2 or belts 2, 3, 4, respectively and which may also be utilized for holding the belts 2, 3, 4 taut.

Figure 3:
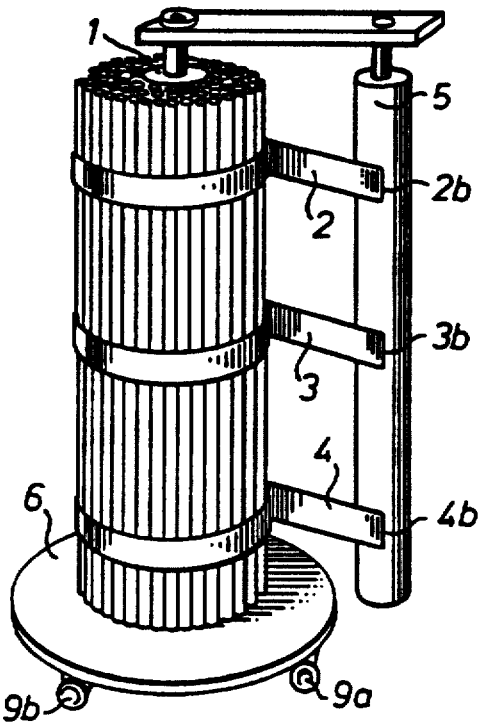
FIG. 3 shows the apparatus according to FIG. 1 with elongate objects stored therein.

Finally, the apparatus according to the present invention is provided with a holding device 6 which prevents the wound-up package from being unintentionally unwound. This holding device may be designed in different manners and-is illustrated in FIGS. 1-3 solely as a base plate 6 against which the one ends of the elongate objects are prevented by friction from being displaced and thereby unwound. A second design of the holding device will be described in detail below with reference to the embodiment according to FIG. 4 and is illustrated more closely in FIG. 5. Furthermore, the holding device is fitted with suitable wheels 9a, 9b etc. for simple displacement by rolling to the different machining stations and points of use of the elongate objects 20, 21, 22, 23, etc. If necessary or desirable, the drum 1 may itself also be provided with suitable means (not shown) for preventing unintentional rotation of the drum.

Figure 4:
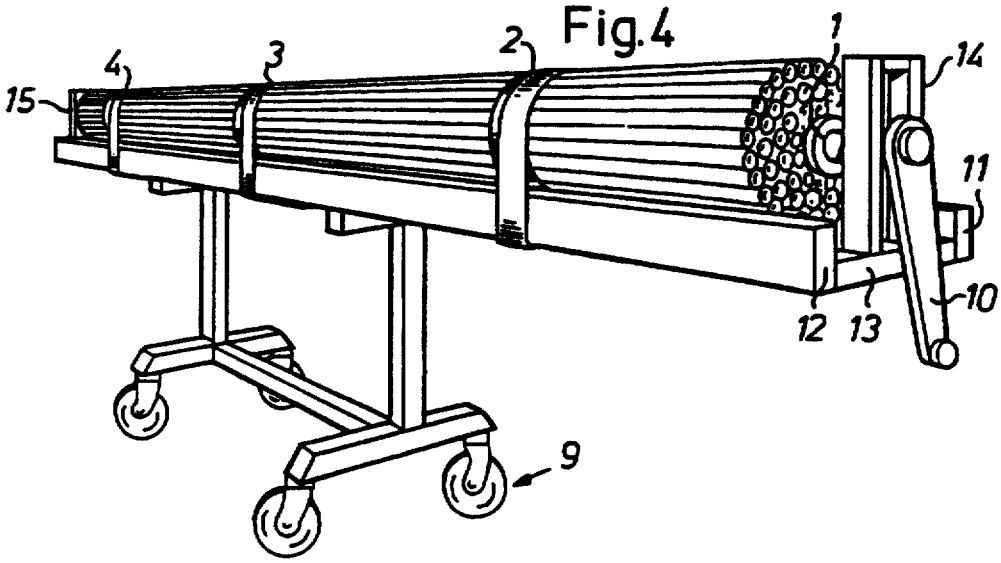
FIG. 4 shows the basic design of a second embodiment of the present invention with elongate objects stored therein.

In a second design according to FIG. 4, the rotary drum 1 is disposed horizontally instead of vertically as in FIGS. 1 and 3. Rotation of the drum I in and relative to a frame 11, 12, 13, 14, 15 etc. is here realized by the driving of a motor (not shown) by means of a crank 10 which is rotatably journalled in the above-mentioned frame and is mechanically connected to the drum 1 which is rotary in relation to the frame. The design illustrated in FIG. 4 has been fed with a large number of pipes or tubes in substantially the same manner as in the embodiment according to FIG. 3, but, in this instance, the elongate objects have been supplied to the apparatus disposed horizontally. The choice of horizontal or vertical infeed and discharge (or any direction therebetween) of the elongate objects depends upon different circumstances in each individual case, for example in relation to the length of the objects, how they are to be subsequently machined, handled, etc.

A suitable number of holding devices 6 is disposed between the longitudinal beams, 11, 12 of the frame. The former are advantageously disposed in register with each respective belt 2, 3, 4 and hence are three in number in this particular instance, while fewer or more than three may of course be employed. As will be apparent from FIG. 5, each holding- device comprises, for example, a cross-beam or support member 6d disposed between the longitudinal beams 11, 12 and mechanically connected thereto, the cross-beam having a curved upper face 6a which very roughly corresponds to the curvature of the-outer surface of the round battery formed by the elongate objects in the wound-up state. Two hoses 8a, 8b are provided on the upper face of the cross-beam 6d and parallel therewith, the hoses running mutually parallel but disposed slightly apart from one another. These hoses 8a, 8b consist of a suitable yieldable material, for instance rubber, and are filled with a suitable liquid, for example water, the hoses being clamped at their ends in a manner not shown in detail on the drawing. A pressure-distributing sheet 7 is disposed on the upper side of the hoses 8a, 8b, and may, for instance, consist of a bent plate. A gaseous or fluid medium may be supplied between the upper side of the sheet 7 and the outer side of the belt 2 via a tube 6b disposed between the hoses 8a, 8b and discharging on the upper side of the sheet 7 in order, if necessary—for example on unwinding the belt 2 etc. from the drum 1—to reduce the friction between the outer side of the belt 2 etc. uting sheet 7 is disposed on the upper side of the hfor example, compressed air.

Figure 5:
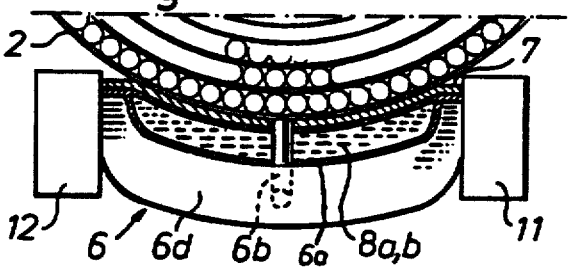
FIG. 5 shows a part of the embodiment according to FIG. 4.

In the embodiment according to FIGS. 4 and 5, the drum 1 rests —thanks to the vertical movable journalling of the drum 1 in the frame members 14 and 15—with the elongate objects 20, etc. wound up thereon by means of the belts 2, 3 and 4, against the upper side of its associated sheet 7 by force of gravity, whereby unintentional rotation will be prevented. Moreover, the drum 1 per se may be provided with suitable releasable devices which prevent rotation of the drum 1. Furthermore, the belts 2, 3, 4 are, at their outer ends, suitably stretched, coiled and fixed in the frame 11, 12, 13 (not shown in detail on the drawing) in order to prevent all unintentional discharge of elongate objects.

Finally, the frame 11, 12, 13, 14, 15 with its associated drum 1, belts 2, 3, 4 and the elongate objects 20, 21, 22, 23, 24, 25, etc. is advantageously disposed as a unit on a suitably adapted carriage with wheels 9 for simple displacement of the unit to the desired position.

When elongate objects are to be unloaded, the belts 2, 3, 4 are first released and passed over, for example, idler rollers (not shown) to a coiling apparatus (not shown) which, on rotation unwinds the belts 2, 3, 4 from the drum 1, whereby the elongate objects are progressively and sequentially paid out on the stretched belts 2, 3 and 4 and led further, suitably—as described in the foregoing—by the application of compressed air or the like between the outer face of the belts 2, 3 and 4 respectively, and the upper side of the sheet 7 in order to reduce the friction therebetween.

The belts 2, 3, 4 may, as an alternative or supplement to the drag of the drum I also be positively fed in the winding-up direction, and the elongate objects 20, 21, 22, 23, 24, 25, etc. may likewise be positively fed in the winding-up direction and/or in the unwinding direction.

Theoretically, the holding device 6 may be varied in a number of different ways as long as it is capable of preventing rotation. However, such a holding device might well be dispensed with if the belts 2, 3, 4 etc. are made sufficiently long and provided with mutually cooperating locking members, for example velcro tapes, on each respective outer end 2*b*, 3*b* and 4*b* such that each outer end locks itself by the intermediary of the velcro tape.

The present invention should not be considered as restricted to that described above and shown on the drawings, many modifications being conceivable without departing from the spirit and scope of the appended claims.

I claim and desire to secure by Letters Patent is:

1. An apparatus for the controlled infeed, storage and discharge of elongate objects, comprising:

a rotary drum;

at least one belt substantially perpendicular to said drum and having a main body and a leading portion by which the main body is connected to said drum, said main body having a given thickness throughout its length and at least part of said leading portion being thicker than said given thickness; and means for winding said at least one belt on said drum as the elongate objects are aligned with said drum and disposed on only the main body of said at least one belt such that the objects are retained on said drum by said at least one belt.

2. The apparatus of claim 1, further comprising holding means for preventing unintentional rotation of said drum to avoid release of the elongate objects.

3. The apparatus of claim 2, wherein said holding means releasably abuts against the elongate objects.

4. The apparatus of claim 2, wherein said holding means releasably abuts against said at least one belt.

5. The apparatus of claim 4, wherein said at least one belt is a minimum of two belts spaced from each other along said drum, and a plurality of holding means being arranged such hat one holding means is associated with each of said belts.

6. The apparatus of claim 4, wherein the holding means includes a pressure distributor in contact with at least one of its associated belt and the elongate elements, and friction reducing means to lower the degree of such contact.

7. The apparatus of claim 6, wherein said pressure distributor is a sheet disposed to abut against at least one of a surface of tis associated belt facing away from said drum and the elongate elements, and a resilient member disposed on a stationary support member and engaging said pressure distributor to urge it toward said at least one of the belt and elongate elements; and wherein said friction reducing means injects one of a gaseous and fluid medium under pressure between said pressure distributor and said at least one of the belt and elongate elements.

8. The apparatus of claim 1, further comprising a transportable base on which said drum and said at least one belt, along with the elongate objects retained on said drum, are mounted.

9. The apparatus of claim 1, wherein said leading portion of the at least one belt has an outer layer which is an extension of the main body and an inner elastic layer of a length to substantially encircle said drum as the belt is wound around it.

10. The apparatus of claim 9, wherein the thickness of said elastic layer is substantially the same as the diameter of the elongate objects.

11. An apparatus for the controlled infeed, storage and discharge of elongate objects, comprising:

a rotary drum and at least two belts spaced along the length of said drum and connected thereto, said rotary drum being arranged to rotate in two different directions for winding-up and winding-out of said at least two belts;

the elongate objects being aligned with said drum and disposed on said at least two belts, and are arranged to be retained by said at least two belts against the rotary drum;

said at least two belts and/or said elongate objects being disposed to be prevented from moving by a holding device, while in the storage position; and each of said at least two belts having one holding device allocated therefore.

12. A apparatus for the controlled infeed, storage and discharge of elongate objects comprising:

a rotary drum and at least one belt, connected to the rotary drum which is arranged to rotate in two different directions for winding-up and winding-out of said at least one belt;

the elongate objects being aligned with said drum and disposed on said at least one belt, and are arranged to be retained by said at least one belt against the rotary drum;

said at least one belt and/or said elongate objects being disposed to be prevented from moving by a holing device, while int eh storage position;

each holding device including a pressure distributor and a friction reducer which are arranged to cooperate with associated belts and/or with the stored, elongate objects, a pressure distributing sheet disposed to abut against the surface of said at least one belt facing away from said drum, and two hoses suitably filled with fluid and disposed to abut against the surface of said pressure distributing sheet facing away from said drum, said hoses being disposed to be supported by a stationary support member; and wherein the friction reducer includes a gaseous or fluid medium under pressure which is disposed to be supplied for friction reduction between the pressure distributing sheet and said at least one belt and/or between the pressure distributing sheet and the elongate objects.

* * * * *